United States Patent [19]

Iwata et al.

[11] 3,999,566

[45] Dec. 28, 1976

[54] METHOD AND APPARATUS FOR DISCHARGING OVERBOARD EXCESS WATER FROM HOPPER OF HOPPER SUCTION DREDGER OR BARGE OR SCOW

[75] Inventors: Shigeo Iwata; Ichiro Ofuji, both of Tokyo; Susumu Waseda, Yokohama; Naoshi Ishimatsu, Funabashi, all of Japan

[73] Assignees: Ishikawajima-Harima Jukogyo Kabushiki Kaisha; Tokushu Shunsetsu Kabushiki Kaisha, both of Tokyo, Japan

[22] Filed: Aug. 21, 1975

[21] Appl. No.: 606,596

[52] U.S. Cl. ..... 137/1; 37/58; 210/521; 299/9

[51] Int. Cl.[2] ..... B65G 53/30

[58] Field of Search ..... 37/58, 59, 54; 210/221 R, 532 R; 299/9

[56] References Cited

UNITED STATES PATENTS

| | | | |
|---|---|---|---|
| 1,314,955 | 9/1919 | Flicker | 210/221 UX |
| 2,799,396 | 7/1957 | Belaskas | 210/221 |
| 3,658,386 | 4/1972 | Laarman | 37/58 X |

*Primary Examiner*—Alan Cohan
*Attorney, Agent, or Firm*—Scrivener Parker Scrivener & Clarke

[57] ABSTRACT

A method and apparatus for discharging overboard the excess water from the hopper of a hopper suction dredger, barge or scow for removing the air bubbles contained in the discharged water and for preventing the air bubbles from being entrained into the discharged water in order to prevent the turbidity of the water in the dredging area.

10 Claims, 6 Drawing Figures

Fig. 1
PRIOR ART
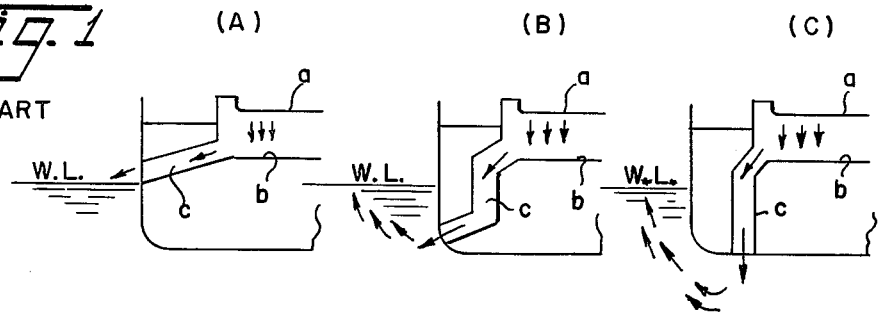
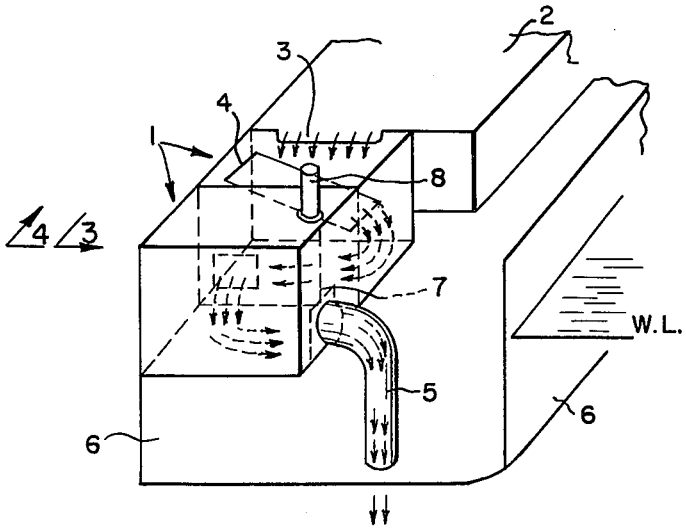
Fig. 2
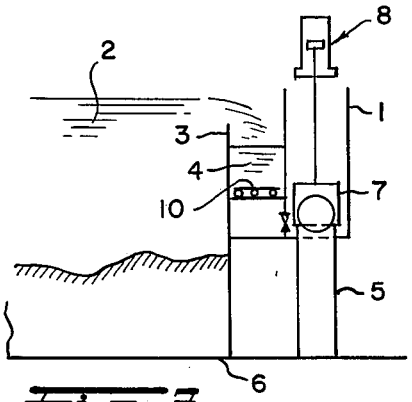
Fig. 3
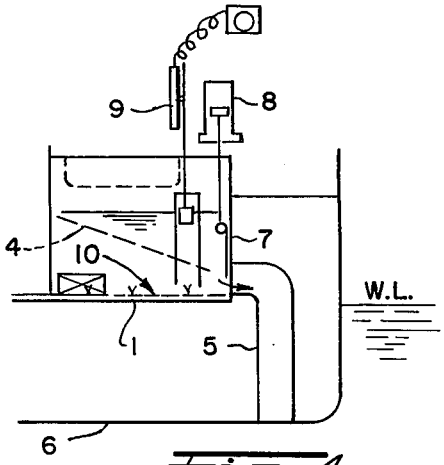
Fig. 4
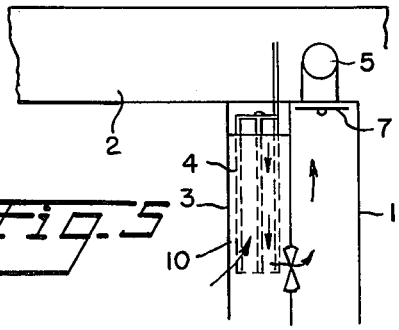
Fig. 5
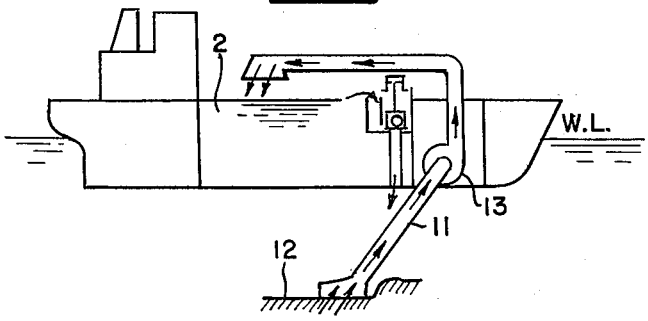
Fig. 6

METHOD AND APPARATUS FOR DISCHARGING OVERBOARD EXCESS WATER FROM HOPPER OF HOPPER SUCTION DREDGER OR BARGE OR SCOW

DETAILED DESCRIPTION OF THE INVENTION

The present invention relates to a method and apparatus for discharging overboard the excess water from the hoppers of hopper suction dredgers, barges or scows so that the water in the dredging area may not become turbid and the fine particles contained in the excess water discharged overboard may be settled quickly onto the sea bottom.

In this specification, the method and apparatus according to the present invention will be described as being applied to a trailing hopper suction dredger which operates with the dragarms trailing, as it slowly moves along its course under its own power. The sea bottom material is continuously raised by the dredge pump through the dragarm and is discharged into the hopper of the dredger or barges alongside. The relatively larged solid particles of the dredged material settle down in the hopper while the relatively small solid particles floating in the water are discharged overboard as the excess water is discharged. Therefore the water in the dredging area becomes considerably turbid by the excess water discharged overboard from the dredger. In order to overcome this water turbidity problem, there has long been a strong demand for an effective method and apparatus for discharging the excess water overboard without causing the turbidity of the surrounding water and for quickly settling down the solid particles contained in the excess water discharged overboard.

The prior art excess water discharging methods are shown in FIG. 1. In the method shown in FIG. 1(A), the excess water discharge outlet is disposed above the water line W.L. That is, the excess water above the overflow level *a* in the hopper is discharged through an overflow trough *b* and an overflow chute *c* directly onto the surface of the water so that the surrounding water becomes considerably turbid. In the methods shown in FIGS. 1(B) and 1(C), the excess water above the overflow level *a* is discharged through the overflow trough *b* and chute *c* into the body of water below the water line W.L. However, much air is entrained into the excess water falling from the hopper into the overflow trough *b* so that when the excess water is discharged overboard, the so-called "air-lift" phenomenon occurs. That is, a large number of air bubbles float together with the fine solid particles contained in the discharged excess water to the surface so that the surrounding water becomes also considerably turbid as with the method shown in FIG. 1(A).

In order to overcome the above problems, the inventors had conducted extensive studies and experiments and were led to the conclusion that the water turbidity is caused by the so-called "air-lift" phenomenon; that is, by the rising or floating to the surface of the air bubbles together with the fine solid particles contained in the discharged water, the air bubbles being entrained in the excess water when the latter overflows from the hopper into the overflow trough. Further experiments led the inventors to the conclusion that if the air bubbles entrained into the excess water in the overflow trough are removed, the floating of the fine solid particles contained in the discharged excess water may be substantially prevented.

One of the objects of the present invention is therefore to provide a method and apparatus for discharging overboard the excess water from the hopper of a trailing hopper dredger or barge or scow without causing the turbidity of the water in the dredging area.

The above and other objects, features and advantages of the present invention will become more apparent from the following description of one preferred embodiment thereof taken in conjunction with the accompanying drawing in which:

FIGS. 1(A), 1(B) and 1(C) are schematic views showing the prior art methods for discharging overboard the excess water;

FIG. 2 is a schematic perspective view of half side of a hopper suction dredger of one preferred embodiment of the present invention;

FIG. 3 is a schematic side view looking in the direction indicated by the arrow III of FIG. 2;

FIG. 4 is a schematic side view looking in the direction indicated by the arrow IV of FIG. 2;

FIG. 5 is a schematic top view thereof; and

FIG. 6 is a schematic view of a hopper suction dredger incorporating the present invention.

Referring to FIGS. 2 through 5, a plurality of overflow troughs 1 (two, in the instant embodiment) are disposed on the overflow side of a hopper 2 in such a way that there may be provided a plurality of bends in a path in the overflow troughs 1 of the excess water overflowing from the hopper 2. In other words, the overflow troughs 1 are so arranged that there may be provided a long path of the water flowing through the overflow troughs 1. In the first trough 1 adjacent to the hopper 2 is disposed an inclined baffle 4 so that the water overflowing from the hopper 2 may impinge upon the baffle 4. An overflow chute 5 is extended between the second overflow trough 1 and the bottom 6 of the dredger so that the water discharged out of the overflow trough 1 may be returned overboard. At the discharge spot or at the inlet of the overflow chute 5 is disposed a gate 7 which is opened or closed by a hydraulic cylinder 8 so that the level of the water in the overflow troughs 1 may be maintained at a predetermined level. Alternatively, the gate 7 may be disposed in the overflow chute 5. Within the overflow trough 1 is disposed a liquid level measuring instrument 9 which, together with the hydraulic cylinder 8, is operatively coupled to a manual or automatic control system (not shown) so that the gate 7 may be automatically opened or closed in response to the level of water in the overflow trough 1. Within the overflow trough 1 are disposed air pipes 10 for blowing the compressed air into the excess water flowing through the overflow trough 1.

Next the mode of operation will be described. The water passes over the overflow weir 3 and falls upon and flows along the baffle 4 into the first trough 1. Therefore the kinetic energy of the falling water is satisfactorily absorbed by the baffle 4 so that the air bubble formation may be effectively reduced. Within the overflow troughs 1 the water flows through the relatively long path indicated by the arrows in FIG. 2, changing the direction at the bends so that the air bubbles contained in the water float to the surface and disperse into the atmosphere. Since the path of the water in the overflow troughs 1 is long, there may be provided a sufficient time to float the air bubbles contained in the water to the surface and to remove them before the water flows into the overflow chute 5. If the length of the path is not sufficient to cause the fine air bubbles to float to the surface, compressed air may be blown into the water through the air pipes 10. This facilitates the formation of air bubbles in the water and increases the rising speed of the air bubbles so that the air bubbles may be sufficiently removed. Thus the water discharged overboard through the overflow chute 5 contains almost no air bubbles. When the level of the water in the overflow troughs 1 is lower than the level of the inlet to the overflow chute 5, the air bubbles flow into the chute 5. To overcome this problem, the gate 7 is disposed at the inlet of or within the overflow chute 5 so that the water in the overflow troughs 1 may be maintained at a constant level. That is, the level of the water may be maintained at a level higher than the inlet to the overflow chute 5. Thus, the flow of air bubbles into the overflow chute 5 may be prevented.

Since the water discharged overboard through the overflow chute 5 contains no air bubbles, the solid particles contained in the discharged water form a group flow and settle down onto the sea bottom without floating to the surface under a high water head in the overflow troughs 1.

As shown in FIG. 6, a trailing hopper suction dredger trails a dragarm 11 with a drag in contact with the sea bottom 12 so that the bottom material is sucked through a suction pipe by a dredge pump 13 into the hopper 2. The volume of the mixture of the dredged material and water is dependent upon the pressure under which the drag is pressed against the bottom and the composition of the bottom material. Therefore the overflow rate changes dependent upon the volume of the dredged material discharged into the hopper so that it is not constant. In order to maintain the level of water constant in the overflow troughs 1, the opening degree of the gate 7 is controlled by the hydraulic cylinder 8 which in turn is controlled in response to the signal from the instrument 9.

So far only one preferred embodiment of the present invention has been described, and it will be understood that various modifications may be effected within the true spirit of the present invention. For instance, instead of the gate 7 disposed at the inlet of the overflow chute 5, the gate may be disposed in the overflow chute 5 below the water level W.L. When the overflow is started, the gate below the water line is closed so that the water completely fills the overflow chute 5, discharging the air completely out of the overflow chute 5 above the water line. After the overflow chute 5 is completely filled with the discharged water, the gate below the water line is opened to discharge the water overboard and controlled to maintain the water level in the trough at predetermined level. This modification is also very effective for removing or eliminating the air bubbles in the discharged water. Instead of the gate 7 or the gate below the water line a valve may be used, and the excess water may be directly discharged overboard from the second overflow trough 1 through the opening of the bottom 6 of the dredger so that the overflow chute 5 may be eliminated. Furthermore, instead of providing the bends in the path of the excess water in the overflow troughs 1, an overflow trough having a wide width may be used so that the flow velocity of the excess water in the overflow trough may become sufficiently slow to provide the sufficient time to permit the floatation of air bubbles before the excess water is discharged overboard.

As described above, according to the present invention, the air bubbles contained in the excess water from the dredge hopper may be sufficiently removed before the excess water is discharged overboard so that the following advantages may be attained:

i. Since the level of the excess water in the overflow trough may be maintained constant and because the excess water may stay in the overflow trough for a sufficiently long time, no air bubble is contained in the water discharged overboard. Thus the so-called "air-lift" phenomenon in the water outside of the dredge may be prevented.

ii. Because of the merit (i) above, the turbidity of the water in the dredging area may be prevented.

iii. Even when the volume of the mixture of the dredged material and water into the hopper changes, the water level in the overflow trough may be maintained constant by the automatic liquid level control system so that the air bubbles may be prevented from being entrained in the discharged water.

iv. The installation and operation of the apparatus will not adversely affect the normal dredging operation in any way.

v. Since the excess water is discharged after the level of the excess water in the overflow trough reaches a predetermined level and the overflow chute has been completely filled with the water, the entrainment of air bubbles into the discharged water may be completely prevented.

vi. Even fine air bubbles in the excess water may be completely eliminated by blowing the compressed air into the overflow trough.

What is claimed is:

1. A method for discharging muddy water from a hopper of a hopper dredger, comprising overflowing excess water from the hopper to an independent trough, flowing the excess water in the trough through an irregular path and maintaining said excess water in the trough for a time period sufficient that air bubbles are removed, and discharging over board the excess water from the trough to an area below the water line of the dredger.

2. A method as defined in claim 1 wherein compressed air is blown into the excess water as it flows through said overflow trough, thereby eliminating fine air bubbles in the excess water.

3. A method as defined in claim 1 wherein the excess water is discharged overboard only after the level of the excess water in said overflow trough has reached a predetermined level and the passage through which the excess water in said overflow trough is discharged overboard has been completely filled.

4. An apparatus for use with a trailing hopper suction dredger for discharging overboard the excess water from a hopper thereof comprising an overflow trough independent of said hopper into which the excess water in the hopper overflows, a passage connecting the overflow trough to an area below the water line of the dredger through which the excess water in said overflow trough may be discharged overboard, and means for controlling the water level in said trough.

5. An apparatus as defined in claim 4 wherein said overflow trough or troughs are so arranged that the excess water may stay therein for a predetermined time.

6. An apparatus as defined in claim 4 wherein a baffle is disposed within said overflow trough so as to absorb the kinetic energy of the excess water overflowing from said hopper, thereby preventing the formation of air bubbles.

7. An apparatus as defined in claim 4 wherein means for blowing the compressed air into the excess water is provided in said overflow trough along the path of the flow of the excess water therein.

8. An apparatus as defined in claim 6 wherein means for blowing the compressed air into the excess water is provided in said overflow trough along the path of the flow of the excess water therein.

9. An apparatus as defined in claim 4 wherein the control means for the water level in the overflow trough is disposed within the discharge passage below the water line of the dredger.

10. An apparatus as set forth in claim 4 wherein the water level controlling means comprises a valve positioned in said passage, and means controlled by the water level in said trough for operating said valve so that said water level is maintained substantially constant.

* * * * *